US011787175B2

(12) United States Patent
Aizawa et al.

(10) Patent No.: US 11,787,175 B2
(45) Date of Patent: Oct. 17, 2023

(54) LIQUID EJECTING DEVICE

(71) Applicant: SEIKO EPSON CORPORATION, Tokyo (JP)

(72) Inventors: Tadashi Aizawa, Matsumoto (JP); Tsuneyuki Sasaki, Matsumoto (JP); Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 76 days.

(21) Appl. No.: 17/445,985

(22) Filed: Aug. 26, 2021

(65) Prior Publication Data

US 2022/0063269 A1 Mar. 3, 2022

(30) Foreign Application Priority Data

Aug. 28, 2020 (JP) ..... 2020-144242

(51) Int. Cl.

| | |
|---|---|
| ***B41J 2/06*** | (2006.01) |
| ***B41J 11/00*** | (2006.01) |
| ***B41J 2/14*** | (2006.01) |
| ***B41J 2/01*** | (2006.01) |

(52) U.S. Cl.

CPC . *B41J 2/06* (2013.01); *B41J 2/01* (2013.01); *B41J 2/1433* (2013.01); *B41J 11/0024* (2021.01); *B41J 11/00216* (2021.01); *B41J 2002/14491* (2013.01)

(58) Field of Classification Search

CPC ..... B41J 2/06; B41J 2/01; B41J 2/1433; B41J 11/00216; B41J 11/0024; B41J 2002/14491

See application file for complete search history.

(56) References Cited

U.S. PATENT DOCUMENTS

2018/0178676 A1* 6/2018 Cech ..... G01V 3/12

FOREIGN PATENT DOCUMENTS

| | | | | |
|---|---|---|---|---|
| JP | 3576861 B | | 10/2004 | |
| JP | 2008143168 A | * | 6/2008 | ..... B41J 2/1721 |
| JP | 2017-119395 A | | 7/2017 | |
| JP | 2017119395 A | * | 7/2017 | ..... B41J 2/01 |

* cited by examiner

*Primary Examiner* — Yaovi M Ameh

(74) *Attorney, Agent, or Firm* — WORKMAN NYDEGGER

(57) ABSTRACT

Provided is a liquid ejecting device. An alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit. Based on a result detected by a detection unit configured to detect a change in an alternating current electric field generated from the alternating current electric field generation unit, a control unit is configured to stop generation of the high-frequency voltage from the high-frequency voltage generation unit to the first electrode and the second electrode.

6 Claims, 7 Drawing Sheets

LIQUID EJECTING DEVICE

The present application is based on, and claims priority from JP Application Serial Number 2020-144242, filed Aug. 28, 2020, the disclosure of which is hereby incorporated by reference herein in its entirety.

BACKGROUND

1. Technical Field

The present disclosure relates to a liquid ejecting device including a liquid ejecting head configured to eject a liquid such as ink onto a medium such as a sheet.

2. Related Art

JP-A-2017-119395, for example, discloses a liquid ejecting device of an inkjet printer or the like configured to eject a liquid such as ink onto a medium such as a sheet to perform printing. In such a liquid ejecting device, in order to suppress deterioration in printing quality, such as, for example, the occurrence of liquid bleed-through due to a degree to which the medium onto which the liquid was ejected is dried, there is provided a function for generating an alternating current electric field by generation of a high-frequency voltage to positive electrodes and negative electrodes alternately disposed to dielectrically heat the liquid ejected onto the medium and dry the medium onto which the liquid was ejected.

Nevertheless, in the liquid ejecting device described in JP-A-2017-119395, there is a risk of occurrence of an abnormality such as, for example, a change in the generated alternating current electric field due to aging or usage conditions not intended by the designer, a change in the conditions for heating the liquid ejected onto the medium, and excessive heat accumulation in each electrode.

SUMMARY

A liquid ejecting device configured to solve the above-described problems includes a liquid ejecting head configured to eject a liquid onto a medium, an alternating current electric field generation unit configured to generate an alternating current electric field, a control unit configured to control the alternating current electric field generation unit, and a detection unit configured to detect a change in the alternating current electric field generated from the alternating current electric field generation unit. The alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit, and the control unit is configured to stop generation of the high-frequency voltage from the high-frequency voltage generation unit to the first electrode and the second electrode based on a result detected by the detection unit.

A liquid ejecting device configured to solve the above-described problems includes a liquid ejecting head configured to eject a liquid onto a medium, an alternating current electric field generation unit configured to generate an alternating current electric field, a control unit configured to control the alternating current electric field generation unit, and a temperature detection unit configured to detect a temperature. The alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit. The temperature detection unit is configured to detect a temperature of any one of the conductor, the first electrode, and the second electrode, and the control unit is configured to stop generation of the high-frequency voltage from the high-frequency voltage generation unit to the first electrode and the second electrode based on a result detected by the temperature detection unit.

DESCRIPTION OF EXEMPLARY EMBODIMENTS

An exemplary embodiment of a printing system including a liquid ejecting device will be described below with reference to the accompanying drawings.

First Exemplary Embodiment

Figure 1:
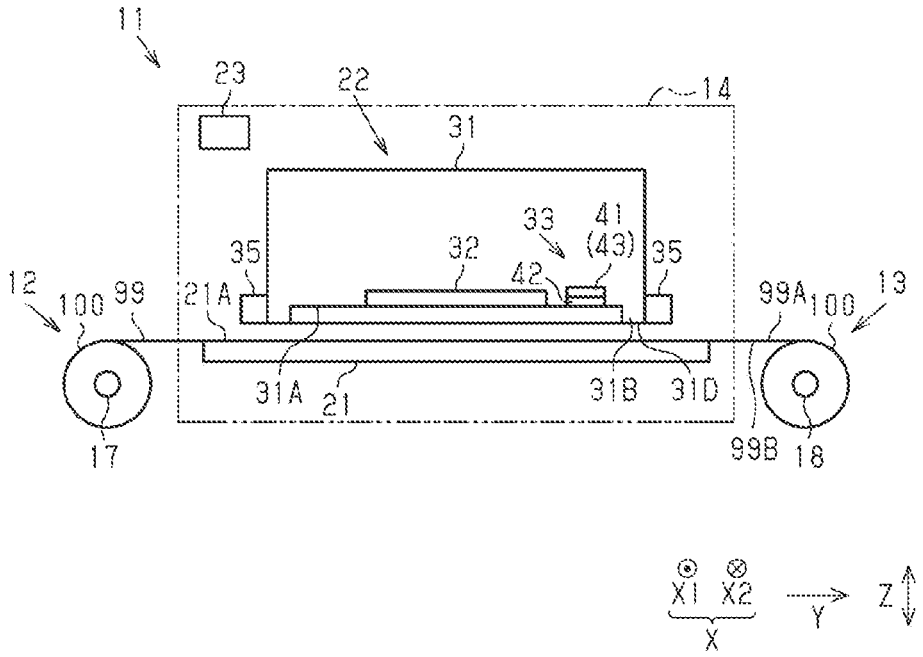
FIG. 1 is a schematic side sectional view illustrating a printing system according to a first exemplary embodiment.

As illustrated in FIG. 1, in the first exemplary embodiment, a printing system 11 includes a holding device 12, a winding device 13, and a liquid ejecting device 14.

The holding device 12 is a device configured to hold a roll body 100 around which a medium 99 is wound. The holding device 12 includes a holding shaft 17 configured to hold the roll body 100. The holding shaft 17 is configured to be rotatable, for example. As the holding shaft 17 rotates, the medium 99 is fed from the roll body 100. In the first exemplary embodiment, the holding shaft 17 is not actively rotated and rotates with the roll body 100 by the medium 99 being pulled from the roll body 100, for example. The medium 99 is, for example, a sheet, fiber, or the like. The holding shaft 17 may be configured to not rotate. In this case, the roll body 100 rotates with respect to the holding shaft 17 by the medium 99 being pulled from the roll body 100.

The winding device 13 is a device configured to wind the medium 99 fed from the holding device 12. The winding device 13 includes a winding shaft 18 configured to wind the medium 99. The winding shaft 18 is configured to be rotatable. The winding shaft 18 winds the medium 99 by rotating. As a result, the winding shaft 18 holds the roll body 100 formed by winding the medium 99. In the first exemplary embodiment, the medium 99 is fed from the roll body 100 held by the holding shaft 17 by rotation of the winding shaft 18.

The medium 99 is transported by being wound around the winding device 13. The medium 99 is transported from the holding device 12 toward the winding device 13. In the first exemplary embodiment, a direction from the holding device 12 toward the winding device 13 is a transport direction Y of the medium 99. The medium 99 includes a front surface 99A and a back surface 99B, which is a surface opposite the front surface 99A.

The liquid ejecting device 14 is a device that performs printing on the medium 99. The liquid ejecting device 14 is, for example, an inkjet-type printer that prints an image such as characters, photographs, and graphics on the medium 99 by ejecting ink, which is an example of a liquid. The liquid ejecting device 14 is positioned between the holding device 12 and the winding device 13 in the transport direction Y.

The liquid ejecting device 14 includes a support portion 21, a printing unit 22, and a control unit 23. The control unit 23 controls at least various components of the liquid ejecting device 14.

The support portion 21 is a member having a plate shape, for example, but may be a glue belt with an adhesive material applied thereto, or an electrostatic adsorption type belt. The support portion 21 supports the medium 99 to be transported. In the first exemplary embodiment, the support portion 21 supports the medium 99 from below. In the first exemplary embodiment, the support portion 21 comes into contact with the back surface 99B of the medium 99.

In the first exemplary embodiment, the support portion 21 includes a surface 21A facing the printing unit 22 in a vertical direction Z. In the first exemplary embodiment, at least the surface 21A of the support portion 21 is constituted by an insulating body. To give a specific example, the surface 21A of the support portion 21 is preferably an insulating body of 0.0001 S/m or less. On the surface 21A of the support portion 21, an anodized aluminum film is formed by an anodization process, but no such limitation is intended and, for example, an insulation coating may be formed by application of an insulating material or the like. Further, for example, the support portion 21 itself may be an insulating material. Further, the surface 21A of the support portion 21 is preferably an insulating body in a region facing the printing unit 22, and may or may not be an insulating body in other regions.

The printing unit 22 faces the support portion 21 in the vertical direction Z. In the first exemplary embodiment, the printing unit 22 is positioned above the support portion 21. The printing unit 22 is configured to print on the medium 99.

Figure 2:
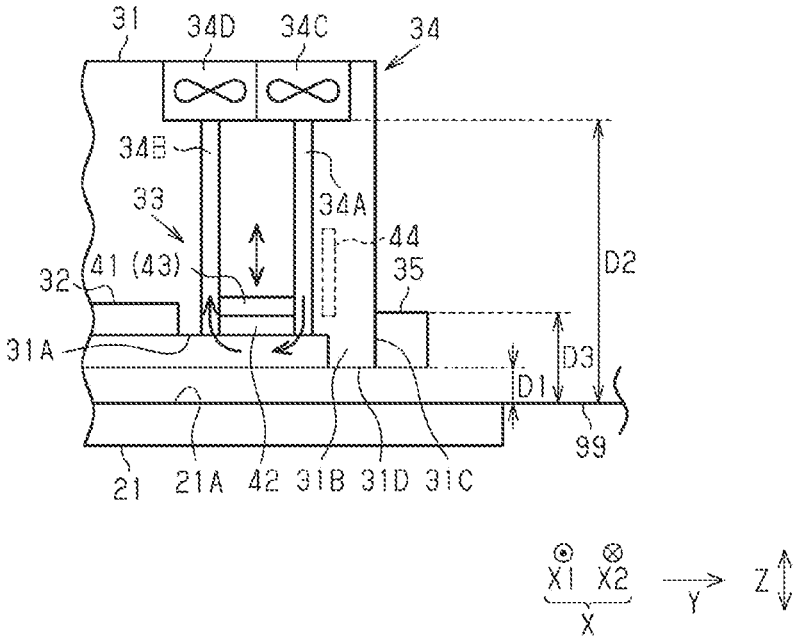
FIG. 2 is a schematic side sectional view of a liquid ejecting device according to the first exemplary embodiment.

As illustrated in FIG. 1 and FIG. 2, in the first exemplary embodiment, the printing unit 22 includes a carriage 31, a liquid ejecting head 32, a drying unit 33, an air blowing mechanism 34, and an optical sensor 35.

The carriage 31 mounts the liquid ejecting head 32, the drying unit 33, the air blowing mechanism 34, and the optical sensor 35. The carriage 31 faces the support portion 21 in the vertical direction Z. In the first exemplary embodiment, the carriage 31 is positioned above the support portion 21. The carriage 31 scans the medium 99 to be transported. That is, the carriage 31 reciprocates across a width of the medium 99 above the support portion 21. At this time, the carriage 31 reciprocates in a width direction X of the medium 99. Thus, in the first exemplary embodiment, the width direction X is a scanning direction of the carriage 31. In the first exemplary embodiment, the liquid ejecting device 14 is a serial printer in which the liquid ejecting head 32 scans the medium 99.

The width direction X indicates two directions including a first width direction X1 and a second width direction X2. The first width direction X1 is a direction opposite the second width direction X2. The width direction X differs from the transport direction Y and the vertical direction Z, and is a direction intersecting both the transport direction Y and the vertical direction Z.

In the first exemplary embodiment, the carriage 31 includes an opposing surface 31A. The opposing surface 31A of the carriage 31 faces the support portion 21. The carriage 31 includes a protruding portion 31B. The protruding portion 31B protrudes downward from the opposing surface 31A at an outer edge portion 31C of the opposing surface 31A of the carriage 31. A distance D1 from a tip end surface 31D of the protruding portion 31B to the surface 21A of the support portion 21 is preferably from 1 mm to 20 mm, ensuring that a finger of a user or the like does not enter between the opposing surface 31A of the carriage 31 and the surface 21A of the support portion 21.

The liquid ejecting head 32 is mounted on the opposing surface 31A of the carriage 31. The liquid ejecting head 32 faces the support portion 21 in the vertical direction Z. In the first exemplary embodiment, the liquid ejecting head 32 is positioned above the support portion 21. Thus, the liquid ejecting head 32 is mounted on the carriage 31, facing the support portion 21.

The liquid ejecting head 32 includes a nozzle plate on which a nozzle for ejecting liquid is formed. The liquid ejecting head 32 ejects liquid onto the medium 99 supported by the support portion 21. As a result, an image is printed on the medium 99. In the first exemplary embodiment, the liquid ejecting head 32 ejects liquid onto the front surface 99A of the medium 99. The liquid ejected by the liquid ejecting head 32 is, for example, a water-based ink that uses water as a solvent.

When the liquid ejecting head 32 ejects the liquid onto the medium 99, the amount of moisture contained in the medium 99 increases. That is, the liquid ejecting head 32 applies, to the medium 99, a process of ejecting the liquid onto the medium 99, thereby increasing the amount of moisture contained in the medium 99.

The drying unit 33 is mounted on the opposing surface 31A of the carriage 31. The drying unit 33 includes an alternating current electric field generation unit 41 and a cover 42. The alternating current electric field generation unit 41 faces the support portion 21 in the vertical direction Z. In other words, the alternating current electric field generation unit 41 faces the medium 99 supported by the support portion 21 in the vertical direction Z. In the first exemplary embodiment, the alternating current electric field generation unit 41 is positioned above the support portion 21.

The alternating current electric field generation unit 41 generates an alternating current electric field. In the first exemplary embodiment, the alternating current electric field generation unit 41 applies, to the medium 99, a process of generating an alternating current electric field, thereby heating the moisture contained in the medium 99 and decreasing the amount of moisture contained in the medium 99. That is, the alternating current electric field generation unit 41 is capable of heating the liquid ejected onto the medium 99 supported by the support portion 21 and drying the medium 99.

In the first exemplary embodiment, the alternating current electric field generation unit 41 heats the liquid by generating an alternating current electric field of 2.4 GHz, but no such limitation is intended. For example, high-frequency dielectric heating by generating an alternating current electric field of from 3 MHz to 300 MHz and microwave heating by generating an alternating current electric field of from 300 MHz to 30 GHz may be used, and among these, generating an alternating current electric field of from 10 MHz to 20 GHz is preferable.

Figure 3:
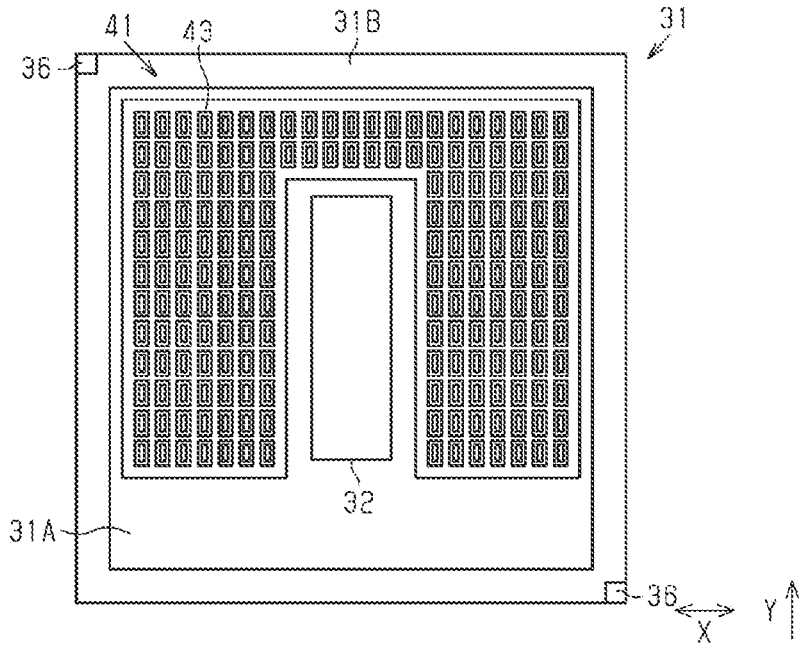
FIG. 3 is a schematic bottom view illustrating a carriage according to the first exemplary embodiment.

As illustrated in FIG. 3, the alternating current electric field generation unit 41 includes a plurality of generators 43 that generate an alternating current electric field. The plurality of generators 43 are disposed across a plurality of columns so as to surround the liquid ejecting head 32 on both side in the width direction X and downstream in the transport direction of the medium 99. The plurality of generators 43 are disposed inward of an outer periphery of the carriage 31 so that the generated alternating current electric field does not affect an exterior of the carriage 31.

Further, an electric field detection sensor 36 is mounted on the carriage 31. In the first exemplary embodiment, the electric field detection sensor 36 is configured to include a pair of electric field detection antennas that detect an alternating current electric field. The electric field detection sensor 36 faces the support portion 21 in the vertical direction Z. The electric field detection sensor 36 is disposed at end portions of the carriage 31. Specifically, one of the pair of electric field detection antennas is disposed at a corner of the carriage 31 when the carriage 31 is viewed from the opposing surface 31A. The other of the pair of electric field detection antennas is disposed at a corner diagonal to the corner of the carriage 31 where the one electric field detection antenna is disposed when the carriage 31 is viewed from the opposing surface 31A. Accordingly, the pair of electric field detection antennas are positioned diagonally on the carriage 31, but are not limited thereto. In this way, the electric field detection sensor 36 is disposed so that the electric field detection antennas are in positions spaced apart from the generators 43, and detects changes in the alternating current electric field generated from the alternating current electric field generation unit 41. In the first exemplary embodiment, the electric field detection sensor 36 corresponds to an example of a detection unit.

Figure 4:
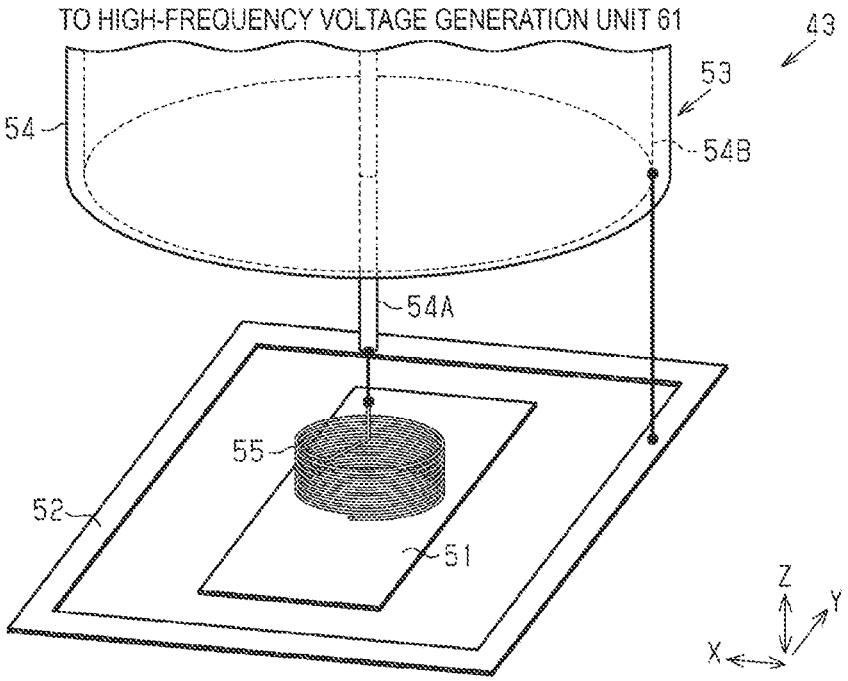
FIG. 4 is a perspective view illustrating a generator according to the first exemplary embodiment.

As illustrated in FIG. 4, the generator 43 includes a first electrode 51, a second electrode 52, and a conductor 53. The first electrode 51 is a flat plate having a rectangular shape in plan view. The first electrode 51 faces the support portion 21. The first electrode 51 is positioned above the support portion 21. The second electrode 52 is a flat plate having a hollow rectangular shape surrounding the first electrode 51 in plan view. The second electrode 52 faces the support portion 21. The second electrode 52 is positioned above the support portion 21. In this way, the first electrode 51 and the second electrode 52 are disposed adjacent to each other. Further, the first electrode 51 and the second electrode 52 are mounted on the carriage 31 so as to face the support portion 21.

The conductor 53 electrically couples the first electrode 51 and the second electrode 52 to a high-frequency voltage generation unit 61 that generates a high-frequency voltage. The conductor 53 includes a coaxial cable 54 and a coil 55. The coaxial cable 54 includes an inner conductor 54A and an outer conductor 54B. The inner conductor 54A is coupled to the first electrode 51 with the coil 55 interposed therebetween, and electrically couples the high-frequency voltage generation unit 61 and the first electrode 51. The outer conductor 54B is coupled to the second electrode 52, and electrically couples the high-frequency voltage generation unit 61 and the second electrode 52. The coil 55, as an example of a winding, is coupled between the first electrode 51 and the inner conductor 54A of the coaxial cable 54, and is preferably disposed at a position as close to the first electrode 51 as possible.

A minimum spacing distance between the first electrode 51 and the second electrode 52 is 1/10 or less of the wavelength of the alternating current electric field output from the alternating current electric field generation unit 41. Thus, most of the alternating current electric field generated when a high-frequency voltage is applied can be attenuated in the vicinity of the first electrode 51 and the second electrode 52. Thus, a strength of an electromagnetic wave arriving far from the first electrode 51 and the second electrode 52 can be reduced. That is, the alternating current electric field generated from the alternating current electric field generation unit 41 is very strong near the first electrode 51 and the second electrode 52 and is very weak at a distance.

With such a generator 43, the frequency band of the generated alternating current electric field is appropriately controlled, making it possible to generate an alternating current electric field in a concentrated manner in a range in the vicinity of the first electrode 51 and the second electrode 52, for example, in a range of from 3 mm to 3 cm, and an alternating current electric field effect is not likely to be exerted beyond that range.

As illustrated in FIG. 1 and FIG. 2, in the first exemplary embodiment, the cover 42 is mounted on the carriage 31. In the first exemplary embodiment, the cover 42 is positioned below the alternating current electric field generation unit 41. In the first exemplary embodiment, the cover 42 covers the alternating current electric field generation unit 41 from below so that foreign material does not adhere to the alternating current electric field generation unit 41. In particular, even when the liquid ejected from the liquid ejecting head 32 is atomized, in the first exemplary embodiment, the cover 42 covers the alternating current electric field generation unit 41 from below so that the liquid does not adhere to the alternating current electric field generation unit 41. Thus, in the first exemplary embodiment, the cover 42 is mounted on the carriage 31 between the alternating current electric field generation unit 41 and the support portion 21 so as to cover the generators 43 of the alternating current electric field generation unit 41.

In the first exemplary embodiment, the cover 42 is formed of a material that transmits the alternating current electric field generated from the alternating current electric field generation unit 41. To give a specific example, the cover 42 may be formed of glass, but is not limited thereto, and may, for example, be formed of a resin having transmissivity such as a cyclic olefin copolymer, and is preferably a material not readily affected by dielectric heating. In the first exemplary embodiment, a surface of the cover 42 has projections and depressions, and thus the alternating current electric field generated from the alternating current electric field generation unit 41 can be converged toward the medium 99 supported by the support portion 21.

In particular, in the first exemplary embodiment, preferably the material of the cover 42 is selected from the perspectives of liquid adherence, liquid cleaning properties, and strength and, in terms of thickness and transmittance of the alternating current electric field, various materials can be employed by changing the frequency and the arrangement of the alternating current electric field generation unit 41.

The drying unit 33 includes an adjustment mechanism 44 capable of moving the generators 43 and the cover 42 of the alternating current electric field generation unit 41 in the vertical direction Z. As a result, the drying unit 33 can adjust a distance between the alternating current electric field generation unit 41 and the medium 99. The adjustment mechanism 44 may be a link mechanism or a rack and pinion mechanism, for example. Therefore, the distance between the alternating current electric field generation unit 41 and the medium 99 can be adjusted in accordance with the type of the medium 99, the type of liquid ejected from the liquid ejecting head 32, and the like. Thus, in the first exemplary embodiment, the adjustment mechanism 44 changes the distance from the first electrode 51 and the second electrode 52 of the generator 43 to the support portion 21. In the first exemplary embodiment, the adjustment mechanism 44 corresponds to an example of a changing unit.

As illustrated in FIG. 2, the air blowing mechanism 34 is mounted on the carriage 31. The air blowing mechanism 34 includes a first passage 34A, a second passage 34B, a first air blowing fan 34C, and a second air blowing fan 34D.

The first passage 34A is a passage extending in the vertical direction Z between the generators 43 and the outer edge portion 31C of the carriage 31, and is thus adjacent to the generators 43. The second passage 34B is a passage extending in the vertical direction Z between the liquid ejecting head 32 and the generators 43, and is thus adjacent to the generators 43. The first passage 34A and the second passage 34B are provided not only downstream of the liquid ejecting head 32 in the transport direction Y of the medium 99, but also on both sides of the medium 99 in the width direction X.

The first air blowing fan 34C is disposed at an upper end of the first passage 34A. The first air blowing fan 34C is a fan that blows air from outside the carriage 31 to the first passage 34A. The second air blowing fan 34D is disposed at an upper end of the second passage 34B of the carriage 31. The second air blowing fan 34D is a fan that blows air from the second passage 34B to outside the carriage 31.

In this way, the driving of the first air blowing fan 34C blows air from outside the carriage 31 to the first passage 34A, and the driving of the second air blowing fan 34D blows air from the second passage 34B to outside the carriage 31. Thus, a gas flows from the outer edge portion 31C toward the liquid ejecting head 32, below the cover 42. In the air blowing mechanism 34 positioned downstream of the liquid ejecting head 32 in the transport direction Y, the gas flows from downstream to upstream in the transport direction Y of the medium 99, below the cover 42. In the air blowing mechanism 34 positioned outward of the liquid ejecting head 32 in the width direction X, the gas flows from outward to inward in the width direction X, below the cover 42. Therefore, even when the liquid ejected from the liquid ejecting head 32 is atomized, it is possible to suppress the adherence of the atomized liquid to the cover 42.

As described above, in the first exemplary embodiment, the first air blowing fan 34C blows air to the generator 43, including the coil 55, the first electrode 51, and the second electrode 52. Thus, the generator 43 is cooled. Conversely, the gas fed to the first air blowing fan 34C is heated by the generator 43. The heated gas is blown to the medium 99 on the support portion 21. As a result, the liquid ejected onto the medium 99 is warmed, making it possible to promote drying of the medium 99.

In the vertical direction Z, a distance D2 between the surface 21A of the support portion 21 and the first air blowing fan 34C as well as the second air blowing fan 34D is greater than a distance D3 between the surface 21A of the support portion 21 and the generator 43 including the coil 55, the first electrode 51, and the second electrode 52. In the first exemplary embodiment, the first air blowing fan 34C and the second air blowing fan 34D correspond to an example of an air blowing unit.

As illustrated in FIG. 1 and FIG. 2, the optical sensor 35 is mounted on the outer peripheral surface of the carriage 31. In the first exemplary embodiment, the optical sensor 35 is attached to the carriage 31 on the outer peripheral surface facing upstream in the transport direction Y, the outer peripheral surface facing downstream in the transport direction Y, the outer peripheral surface facing the first width direction X1 of the width direction X, and the outer peripheral surface facing the second width direction X2 of the width direction X, but no such limitation is intended.

The optical sensor 35 faces the support portion 21. The optical sensor 35 is positioned above the support portion 21. The optical sensor 35 irradiates light downward. That is, the optical sensor 35 irradiates light toward the support portion 21. The optical sensor 35 receives the reflected light and detects an intensity of the received light. The intensity of the light detected by the optical sensor 35 differs depending on whether a finger of the user or the like is between or a finger of the user or the like is not between the optical sensor 35 and the support portion 21. In this way, based on the result detected by the optical sensor 35, it is possible to detect that a finger of the user or the like has entered between the optical sensor 35 and the support portion 21.

Figure 5:
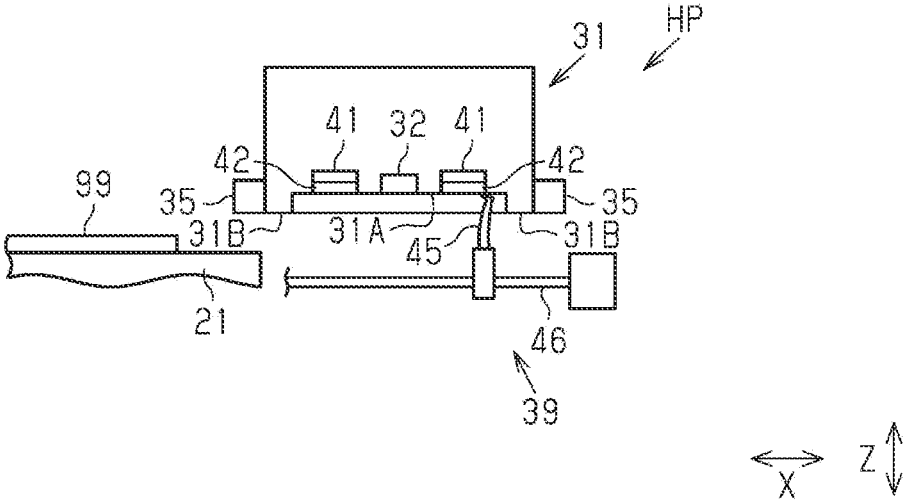
FIG. 5 is a schematic view illustrating a wiping mechanism.

As illustrated in FIG. 5, the liquid ejecting device 14 includes a wiping mechanism 39. The wiping mechanism 39 wipes off a liquid or the like that adheres to the liquid ejecting head 32 and the cover 42. The wiping mechanism 39 is disposed facing the opposing surface 31A of the carriage 31 at a home position HP of the carriage 31. The liquid ejecting head 32 and the cover 42 are disposed on the opposing surface 31A of the carriage 31. Therefore, the wiping mechanism 39 is disposed facing the liquid ejecting head 32 and the cover 42 at the home position HP of the carriage 31. The home position HP of the carriage 31 is a position at one end portion of a movement range of the carriage 31, and is a position at which the carriage 31 is in a standby state.

The wiping mechanism 39 includes a wiper 45 and a movement mechanism 46. The wiper 45 wipes a surface of the liquid ejecting head 32 and the surface of the cover 42. The wiper 45 is made of a resin such as rubber or elastomer, but is not limited thereto, and may be made of cloth, for example. The movement mechanism 46 reciprocates the wiper 45. By the driving of the movement mechanism 46, the wiper 45 reciprocates and moves relative to the liquid ejecting head 32 and the cover 42, wiping the surface of the liquid ejecting head 32 and the surface of the cover 42 that are stationary at the home position HP. Thus, the wiper 45 can remove the liquid adhered to the surface of the liquid ejecting head 32 and the surface of the cover 42, and can form a water repellent film on the surface of the cover 42.

Next, an electrical configuration of the liquid ejecting device 14 will be described.

Figure 6:
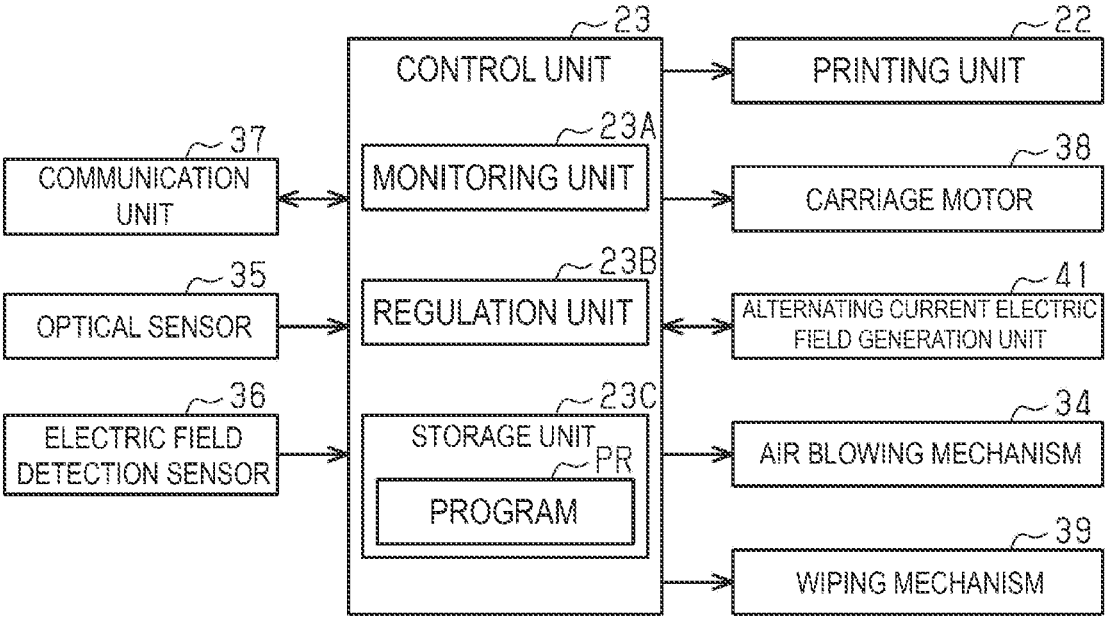
FIG. 6 is a block diagram illustrating an electrical configuration of the liquid ejecting device.

As illustrated in FIG. 6, the liquid ejecting device 14 includes the control unit 23. In the first exemplary embodiment, the control unit 23 may be configured as a circuit including α: one or more processors configured to execute various processes according to a computer program, β: one or more dedicated hardware circuits such as an application-specific integrated circuit configured to execute at least a portion of the various processes, or y: combinations thereof. The processor includes a central processing unit (CPU) and memory such as random-access memory (RAM) and read-only memory (ROM), and stores program codes or commands configured to execute processing on the CPU. The memory, that is, a computer readable medium, includes any readable medium accessible by a general purpose or special purpose computer.

The optical sensor 35, the electric field detection sensor 36, and a communication unit 37 are electrically coupled to the control unit 23. In the first exemplary embodiment, the control unit 23 inputs a signal from the optical sensor 35. In the first exemplary embodiment, the control unit 23 inputs a signal from the electric field detection sensor 36.

In the first exemplary embodiment, the control unit 23 is capable of communicating with a terminal device (not illustrated) via the communication unit 37. The control unit 23 receives signals from the terminal device and transmits signals to the terminal device, as necessary. In the first exemplary embodiment, when instruction information such as a print job is input from the terminal device, the control unit 23 executes processing in accordance with the instruction information, and outputs result information, such as an execution result thereof, to the terminal device. The liquid ejecting device 14 may include an operation unit operable by the user and a display unit that displays various information.

In the first exemplary embodiment, the control unit 23 can communicate with the holding device 12 and the winding device 13 via the communication unit 37. The control unit 23 receives signals from the holding device 12 and the winding device 13, and transmits signals to the holding device 12 and the winding device 13, as necessary. In this way, the control unit 23 may comprehensively control the printing system 11.

The printing unit 22, a carriage motor 38, the alternating current electric field generation unit 41, the air blowing mechanism 34, and the wiping mechanism 39 are electrically coupled to the control unit 23.

In the first exemplary embodiment, the control unit 23 outputs, to the printing unit 22, a signal instructing the printing unit 22 to eject the liquid and perform printing based on printed image data. In the first exemplary embodiment, the control unit 23 outputs a signal for causing the carriage 31 to reciprocate in the width direction X to the carriage motor 38. In the first exemplary embodiment, the control unit 23 outputs a signal related to the driving of the alternating current electric field generation unit 41 to the alternating current electric field generation unit 41. In the first exemplary embodiment, the control unit 23 inputs a signal from the alternating current electric field generation unit 41. In the first exemplary embodiment, the control unit 23 outputs a signal for driving the first air blowing fan 34C and the second air blowing fan 34D to the air blowing mechanism 34. In the first exemplary embodiment, the control unit 23 outputs a signal for driving the wiping mechanism 39 to the wiping mechanism 39.

The control unit 23 includes a monitoring unit 23A and a regulating unit 23B. The monitoring unit 23A monitors whether a regulation condition regulating at least the driving of the alternating current electric field generation unit 41 is satisfied based on a signal from the optical sensor 35, a signal from the electric field detection sensor 36, and a signal from the alternating current electric field generation unit 41. The regulating unit 23B regulates the driving of at least the alternating current electric field generation unit 41 when the regulation condition is satisfied based on the results monitored by the monitoring unit 23A. The control unit 23 includes a storage unit 23C, which is memory such as ROM and RAM. The storage unit 23C stores various data including a program PR.

Figure 7:
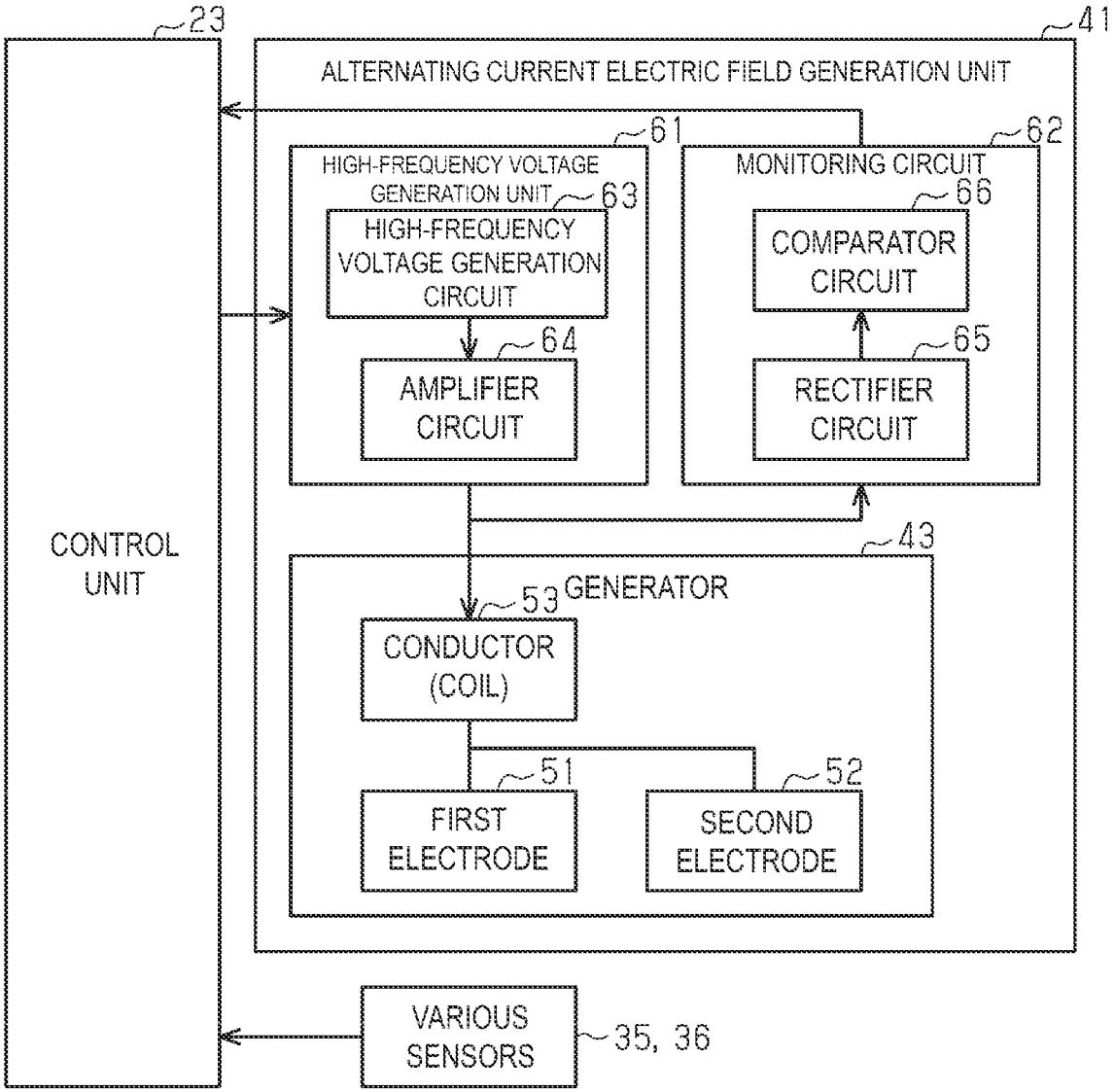
FIG. 7 is a block diagram illustrating the electrical configuration of the liquid ejecting device.

Further, as illustrated in FIG. 7, the alternating current electric field generation unit 41 includes the generators 43, the high-frequency voltage generation unit 61, and a monitoring circuit 62.

The high-frequency voltage generation unit 61 is coupled to the generator 43. Specifically, the high-frequency voltage generation unit 61 is coupled to the first electrode 51 and the second electrode 52 with the conductor 53 interposed therebetween. The high-frequency voltage generation unit 61 generates a high-frequency voltage to the first electrode 51 and the second electrode 52 and outputs the high-frequency voltage to the first electrode 51 and the second electrode 52, thereby generating an alternating current electric field from the first electrode 51 and the second electrode 52.

The high-frequency voltage generation unit 61 includes a high-frequency voltage generation circuit 63 and an amplifier circuit 64. The high-frequency voltage generation circuit 63 is coupled to the control unit 23 and the amplifier circuit 64. The high-frequency voltage generation circuit 63 is a circuit that generates a high-frequency voltage based on a generation instruction signal from the control unit 23, and outputs the high-frequency voltage to the amplifier circuit 64. The amplifier circuit 64 is a circuit that amplifies the high-frequency voltage generated by the high-frequency voltage generation circuit 63 based on the generation instruction signal from the control unit 23 and outputs the amplified high-frequency voltage to the generator 43. In the first exemplary embodiment, the high-frequency voltage generation unit 61 supplies power of 3 kW or less, for example, to the generator 43.

The monitoring circuit 62 is coupled to the high-frequency voltage generation unit 61 and the control unit 23. The monitoring circuit 62 monitors the high-frequency voltage from the high-frequency voltage generation unit 61, and outputs a result of monitoring the high-frequency voltage to the control unit 23.

The monitoring circuit 62 includes a rectifier circuit 65 and a comparator circuit 66. The rectifier circuit 65 is coupled to the high-frequency voltage generation unit 61 and the comparator circuit 66. The rectifier circuit 65 rectifies and smooths the high-frequency voltage from the high-frequency voltage generation unit 61, thereby converting the high-frequency voltage into direct current, and outputs the direct current to the comparator circuit 66.

The comparator circuit 66 is coupled to the rectifier circuit 65 and the control unit 23. The comparator circuit 66 compares the signal output from the rectifier circuit 65 with a reference voltage and, when the signal output from the rectifier circuit 65 exceeds the reference voltage, outputs a signal indicating that the reference voltage has been exceeded to the control unit 23.

In the first exemplary embodiment, by utilizing the characteristics of a changing electrical resistance, that is, impedance, of the coil 55 caused by abnormal heat generation of the coil 55, the monitoring circuit 62 monitors the high-frequency voltage input to the generator 43 and, when the high-frequency voltage exceeds a reference voltage, assumes that a temperature of the coil 55 has increased and detects that abnormal heat generation has occurred in relation to the generator 43. In particular, the temperature of the generator 43 may increase due to the heat generated by the coil 55 and, if temperature variation of the coil 55 can be identified, abnormal heat generation in the generator 43 can be detected. In particular, in the first exemplary embodiment, the coil 55 is made of copper. Copper has an electrical resistance that changes significantly in response to a temperature change and thus, with a temperature rise of about 50° C., detection is possible even with a simple circuit.

In the first exemplary embodiment, in the monitoring circuit 62, a diode for rectification and a capacitor for smoothing are used in the rectifier circuit 65, and a Zener diode is used in the comparator circuit 66 to generate a reference voltage. However, no such limitation is intended. Further, even when the frequency of the alternating current electric field generated by the generator 43 changes due to aging or the like, because the electrical resistance of the generator 43, in particular, the electrical resistance of the coil 55, changes, the occurrence of an abnormality related to the generator 43 can be detected. In the first exemplary embodiment, the monitoring circuit 62 detects a change in the impedance of the generator 43 including the conductor 53, the first electrode 51, and the second electrode 52, and detects a temperature of at least one of the conductor 53, the first electrode 51, and the second electrode 52 based on the detected change. In the first exemplary embodiment, the monitoring circuit 62 corresponds to an example of a detection unit and a temperature detection unit.

In the first exemplary embodiment, when the regulation condition is satisfied when printing is to be started, the control unit 23 cancels the start of printing. When the regulation condition is satisfied after printing is started, while printing is in progress, the control unit 23 cancels the printing. This regulation condition is satisfied based on a signal from the monitoring circuit 62 and signals from the optical sensor 35 and the electric field detection sensor 36.

Below, the printing process executed by the control unit 23 will be described. In the first exemplary embodiment, the control unit 23 is executed when a print job is input via the communication unit 37 after the power source of the liquid ejecting device 14 is turned on. In the first exemplary embodiment, the print job includes printed image data to be printed, a resolution for printing the image, and the like.

In the printing process, the control unit 23 transmits a signal based on the printed image data to the printing unit 22, causing liquid to be ejected from the liquid ejecting head 32. The control unit 23 transmits a signal to the alternating current electric field generation unit 41, driving the alternating current electric field generation unit 41, and generating an alternating current electric field from the alternating current electric field generation unit 41. The control unit 23 transmits a signal to the air blowing mechanism 34, driving the first air blowing fan 34C and the second air blowing fan 34D.

The control unit 23 transmits a signal to the carriage motor 38, causing the carriage 31 to reciprocate in the width direction X. The control unit 23 transmits a signal to the winding device 13 via the communication unit 37, causing the medium 99 to be transported at a speed corresponding to the resolution. Thus, the control unit 23, as a result of ejecting the liquid onto the medium 99, prints an image onto the medium 99. Further, the control unit 23 ends the printing process when a printing end condition, such as completion of the printing of the printed image data, is satisfied.

Next, with reference to FIG. 8, the monitoring process executed by the control unit 23 will be described. In the first exemplary embodiment, after the power source of the liquid ejecting device 14 is turned on, the control unit 23 executes the monitoring process every predetermined interval from input of the print job to satisfaction of the print end condition.

Figure 8:
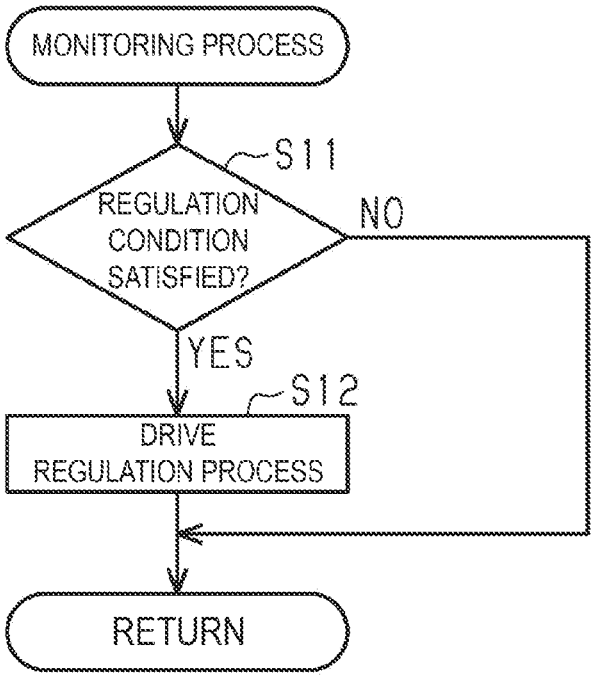
FIG. 8 is a flowchart illustrating a monitoring process.

As illustrated in FIG. 8, in step S11, the control unit 23 determines whether or not the regulation condition is satisfied. When the control unit 23 determines that the regulation condition is not satisfied, the control unit 23 ends the monitoring process without executing step S12. On the other hand, when the control unit 23 determines that the regulation condition is satisfied, the control unit 23 proceeds to step S12.

In the first exemplary embodiment, the regulation condition is satisfied when it is determined that a finger of the user or the like is between the optical sensor 35 and the support portion 21 based on a signal from the optical sensor 35. In the first exemplary embodiment, the regulation condition is satisfied when the detected alternating current electric field exceeds a predetermined strength based on a signal from the electric field detection sensor 36. In the first exemplary embodiment, the regulation condition is satisfied when abnormal heat generation in the generator 43 is detected based on a signal from the monitoring circuit 62 of the alternating current electric field generation unit 41.

In step S12, the control unit 23 executes a drive regulation process and ends the monitoring process. In this process, the control unit 23 stores the regulation information for regulating printing in the storage unit 23C. In the first exemplary embodiment, the regulation information is information erased when the regulation condition is no longer satisfied.

Specifically, when the regulation condition is satisfied after a print job is input, the control unit 23 stores the regulation information in the storage unit 23C and, once the print end condition is satisfied, ends the printing process, and does not start printing. In particular, in the first exemplary embodiment, the control unit 23 does not transmit a signal to the high-frequency voltage generation unit 61 of the alternating current electric field generation unit 41, and thus does not cause the high-frequency voltage generation unit 61 to start generating the high-frequency voltage.

When the regulation condition is satisfied when printing is being performed, the control unit 23 stores the regulation information in the storage unit 23C and, once the print end condition is satisfied, ends the printing process and cancels the printing. In particular, in the first exemplary embodiment, the control unit 23 performs control by shutting off the power source voltage supplied to the amplifier circuit 64 of the high-frequency voltage generation unit 61 of the alternating current electric field generation unit 41, thereby not amplifying the high-frequency voltage. In this way, the control unit 23 shuts off the power source of the amplifier circuit 64, and stops the generation of high-frequency voltage from the high-frequency voltage generation unit 61 to the first electrode 51 and the second electrode 52 based on the result detected by the optical sensor 35, the electric field detection sensor 36, and the monitoring circuit 62. Then, the control unit 23 ends the transmission of the signal to the high-frequency voltage generation unit 61 of the alternating current electric field generation unit 41.

Next, action of the liquid ejecting device 14 will be described.

In the liquid ejecting device 14, the distance between the support portion 21 and the generator 43 as well as the cover 42 of the alternating current electric field generation unit 41 can be adjusted by adjustment of the adjustment mechanism 44. As a result, the distance between the support portion 21 and the generator 43 as well as the cover 42 of the alternating current electric field generation unit 41 can be adjusted to an appropriate distance in accordance with the type of the medium 99 and the type of the liquid.

When a print job is input, the liquid is ejected from the liquid ejecting head 32 onto the medium 99 supported by the support portion 21 based on printed image data. The carriage 31 reciprocates in the width direction X. The medium 99 is transported in the transport direction Y. In this way, an image is printed on the medium 99 to be transported.

When the image is printed on the medium 99, the high-frequency voltage is output from the high-frequency voltage generation unit 61 to the generators 43 based on a signal from the control unit 23. When the high-frequency voltage is input, the generators 43 generate an alternating current electric field, and dry the medium 99 supported by the support portion 21.

When the image is printed on the medium 99, the first air blowing fan 34C and the second air blowing fan 34D are driven based on a signal from the control unit 23. As a result, air is blown from outside of the carriage 31 to the first passage 34A adjacent to the generators 43 of the alternating current electric field generation unit 41. Further, air is blown from the second passage 34B adjacent to the generators 43 of the alternating current electric field generation unit 41 to outside the carriage 31. Thus, the generator 43 can be caused to dissipate heat. A gas heated by the generator 43 is blown to the medium 99 on the support portion 21. As a result, the liquid ejected onto the medium 99 is warmed, making it possible to promote drying of the medium 99. Further, below the cover 42, a gas flows from the outer edge portion 31C toward the liquid ejecting head 32. Therefore, it is possible to suppress the atomization of the liquid ejected from the liquid ejecting head 32 and adherence of the atomized liquid to the cover 42.

The carriage 31 includes the protruding portion 30B and can thus prevent a finger of the user or the like from entering between the carriage 31 and the support portion 21. Further, based on the signal from the optical sensor 35, it is possible to detect that a finger of the user or the like has entered between the carriage 31 and the support portion 21. When it is detected that a finger of the user or the like is to enter between the carriage 31 and the support portion 21, control is performed so that at least the alternating current electric field is not generated from the alternating current electric field generation unit 41.

The electric field detection sensor 36 is disposed in the carriage 31 at a position spaced apart from the generators 43. When it is detected that the alternating current electric field generated from the generators 43 exceeds a specified strength on the basis of a signal from the electric field detection sensor 36, control is performed so that at least an alternating current electric field is not generated from the alternating current electric field generation unit 41. When abnormal heat generation in the generator 43, including the coil 55, is detected based on a signal from the monitoring circuit 62 of the alternating current electric field generation unit 41, control is performed so that at least an alternating current electric field is not generated from the alternating current electric field generation unit 41.

As described above, according to this exemplary embodiment, the following advantages can be achieved.

(1) An alternating current electric field is used to dry the liquid ejected onto the medium 99 and thus, in comparison to a case in which an infrared ray is used, when, for example, the liquid is not ejected onto the medium 99 and a region having an extremely low liquid content is dried, an excessive rise in temperature in the region can be suppressed, making it possible to suppress degradation of the medium 99. Further, not only the medium 99 but also various peripheral members can be similarly suppressed from having an excessive rise in temperature, making it possible to suppress degradation of the various peripheral members, which eliminates the need to excessively arrange heat dissipation members, such as heat insulation materials and reflecting plates, for the various types of peripheral members.

(2) When an alternating current electric field is used, the time from a state of not drying to a state of drying the liquid ejected onto the medium 99, and the time from a state of drying to a state of not drying the liquid ejected onto the medium 99 can be made shorter than when an infrared ray is used.

(3) When an alternating current electric field is used, a member for ensuring visibility is not used in comparison to when a halogen lamp or the like is used. Further, in a halogen lamp or the like, a member such as quartz glass is used, reducing thermal efficiency. However, in the alternating current electric field, such a member is not used and a reduction in thermal efficiency can be suppressed.

(4) The alternating current electric field generation unit 41 is configured to include the first electrode 51 and the second electrode 52 disposed adjacent to each other, the high-frequency voltage generation unit 61 configured to generate a high-frequency voltage to the first electrode 51 and the second electrode 52, and the conductor 53 that electrically couples the first electrode and the second electrode to the high-frequency voltage generation unit 61. As a result, it is possible to concentrate the alternating current electric field near the first electrode 51 and the second electrode 52, improve the heating efficiency to the liquid ejected onto the medium 99 supported by the support portion 21, improve the drying efficiency of the medium 99, and improve the printing quality. On the other hand, generation of an alternating current electric field at a position spaced apart from the first electrode 51 and the second electrode 52 can be made less likely and thus it is unnecessary to excessively arrange members for suppressing the alternating current electric field, making it possible to suppress deterioration of a workability of the liquid ejecting device 14, increase the size of the liquid ejecting device 14, and increase the safety of the user.

(5) Further, while the liquid ejected onto the medium 99 is subjected to dielectric heating in the related art, in order to suppress deterioration in printing quality and achieve higher quality printing, for example, it is desirable to efficiently transmit the generated alternating current electric field to the liquid ejected onto the medium 99 to further improve the efficiency of heating the liquid ejected onto the medium 99. Therefore, herein, the surface 21A of the support portion 21 facing the first electrode 51 and the second electrode 52 can, when constituted by an insulator, cause the electric field to be generated closer to an orientation parallel to the surface 21A of the support portion 21 than when constituted by a conductor. Accordingly, it is possible to improve the efficiency of heating the liquid ejected onto the medium 99 supported by the support portion 21, improve the drying efficiency of the medium 99, and improve the printing quality.

(6) By changing the distance from the first electrode 51 and the second electrode 52 to the support portion 21, it is possible to change the heating depth in the thickness direction of the liquid ejected onto the medium 99 in accordance with the distance. Accordingly, by changing the distance according to, for example, a thickness and a material of the medium 99, an ease of penetration of the liquid, and an ejection amount and a material of the liquid ejected onto the medium 99, or the like, it is possible to dry the medium by heating the liquid in accordance with the state of the medium 99 and thus improve the printing quality.

To give a specific example, depending on the type of the medium 99, for example, the distance between the generator 43 and the support portion 21 can be changed, making it possible to suppress deterioration in the printing quality. Examples of the type of the medium 99 include paper, cloth, a medium in which a plurality of types of fibers are mixed and spun, and a medium containing a functional material such as silver, and flexible adaptations can be made in accordance with the various types of media. Further, the medium 99 can be dried in accordance with the degree of penetration of the liquid into the medium 99, such as by drying the medium 99 after the liquid has penetrated into the medium 99. In particular, in the related art, when the medium 99 is thin paper, for example, and the medium 99 is rapidly and excessively dried, the medium 99 may adsorb the liquid, causing wrinkles to occur in the medium 99. Therefore, herein, the distance between the generator 43 and the support portion 21 can be changed so as to ensure that the medium 99 is not rapidly and excessively dried, making it possible to suppress the occurrence of wrinkles in the medium 99. Further, in the related art, when the medium 99 adopted is configured in multiple layers by bonding a plurality of types of metal plates having different coefficients of thermal expansion, for example, the medium 99 is dried after the liquid has penetrated the medium 99 across multiple layers, and thus wrinkles may occur in the medium 99 due to the different coefficients of thermal expansion. Therefore, herein, the distance between the generator 43 and the support portion 21 can be changed so as to ensure that the medium 99 is dried before the liquid penetrates the medium 99 across multiple layers, making it possible to suppress the occurrence of wrinkles in the medium 99.

(7) The cover 42 that covers the first electrode 51 and the second electrode 52 is provided, making it possible to suppress contact between the medium 99 and the first electrode 51 as well as the second electrode 52 and, even if the liquid ejected from the liquid ejecting head 32 is atomized, suppress adhesion of the atomized liquid to the first electrode 51 and the second electrode 52. Accordingly, it is possible to suppress deterioration in the efficiency of heating the liquid caused by adhesion of atomized liquid to the first electrode 51 and the second electrode 52, suppress deterioration in the drying efficiency of the medium 99, and suppress deterioration in the printing quality.

(8) The wiper 45 that wipes the surface of the cover 42 is provided and thus, even if the liquid ejected from the liquid ejecting head 32 is atomized and the atomized liquid adheres to the surface of the cover 42, it is possible to wipe off the liquid adhered to the surface of the cover 42. Further, in addition to this, a water repellent film is formed on the surface of the cover 42, making it less likely that the atomized liquid will adhere to the surface of the cover 42. Accordingly, it is possible to suppress deterioration in the efficiency of heating the liquid caused by adhesion of atomized liquid to the cover 42, suppress deterioration in the drying efficiency of the medium 99, and suppress deterioration in the printing quality.

(9) In the related art, excessive heat may accumulate in the first electrode 51 and the second electrode 52, such as when, for example, a region of the medium 99 having an extremely low liquid content is dried, causing heat to readily accumulate in the first electrode 51 and the second electrode 52. Therefore, herein, air is blown to the first electrode 51 and the second electrode 52 and thus, even when heat is accumulated in the first electrode 51 and the second electrode 52, the first electrode 51 and the second electrode 52 can dissipate the heat. Accordingly, it is possible to suppress degradation of the first electrode 51 and the second electrode 52 caused by heat, and suppress deterioration in the printing quality.

(10) Further, the distance D2 between the surface 21A of the support portion 21 and the first air blowing fan 34C as well as the second air blowing fan 34D of the air blowing mechanism 34 in the vertical direction Z, that is, the perpendicular direction, is greater than the distance D3 between the surface 21A of the support portion 21 and the first electrode 51 as well as the second electrode 52. Therefore, air is blown from the first electrode 51 and the second electrode 52 toward the support portion 21 in the vertical direction Z and thus, as the first electrode 51 and the second electrode 52 dissipate heat, a heat-bearing gas is blown to the medium 99 supported by the support portion 21. Accordingly, it is possible to improve the efficiency of heating the liquid ejected onto the medium 99 supported by the support portion 21, improve the drying efficiency of the medium 99, and improve the printing quality.

(11) Further, even if the liquid ejected by the liquid ejecting head 32 is atomized, air is blown from the first electrode 51 and the second electrode 52 toward the support portion 21 in the vertical direction Z, making it possible to suppress the adherence of the atomized liquid to the first electrode 51 and the second electrode 52. Accordingly, it is possible to suppress deterioration in the efficiency of heating the liquid caused by adhesion of atomized liquid to the first electrode 51 and the second electrode 52, suppress deterioration in the drying efficiency of the medium 99, and suppress deterioration in the printing quality.

(12) In the related art, excessive heat may accumulate in the coil 55 included in the conductor 53, such as when, for example, a region of the medium having an extremely low liquid content is dried, causing heat to readily accumulate in the coil 55. Therefore, herein, the air blowing mechanism 34 that blows air to the coil 55 included in the conductor 53 is provided and thus, even when heat is accumulated in the coil 55, the coil 55 can dissipate the heat. Accordingly, it is possible to suppress degradation of the coil 55 caused by heat, and suppress deterioration in the printing quality.

(13) The monitoring circuit 62 that detects a temperature of at least one of the conductor 53, the first electrode 51, and the second electrode 52 is provided and, based on the result detected by the monitoring circuit 62, the generation of the high-frequency voltage from the high-frequency voltage generation unit 61 to the first electrode 51 and the second electrode 52 is stopped. Thus, when the temperature of at least one of the conductor 53, the first electrode 51, and the second electrode 52 rises excessively, for example, the generation of the high-frequency voltage can be stopped based on the detected temperature. Accordingly, when heat is accumulated in at least one of the conductor 53, the first electrode 51, and the second electrode 52, it is possible to suppress degradation caused by heat and suppress deterioration in the printing quality.

(14) The high-frequency voltage generation unit 61 generates a high-frequency voltage of from 10 MHz to 20 GHz, and the distance between the surface 21A of the support portion 21 and the tip end surface 31D of the protruding portion 31B is from 1 mm to 20 mm Therefore, the distance between the surface 21A of the support portion 21 and the tip end surface 31D of the protruding portion 31B is set so as to ensure that a finger of the user or the like does not enter between the surface 21A of the support portion 21 and the first electrode 51 as well as the second electrode 52. Accordingly, it is possible to increase safety even when a high-frequency voltage is generated.

(15) Further, in the related art, there is a risk of occurrence of an abnormality such as, for example, a change in the generated alternating current electric field due to aging or usage conditions not intended by the designer, a change in the conditions for heating the liquid ejected onto the medium 99, and excessive heat accumulation in the first electrode 51 and the second electrode 52. Therefore, herein, generation of the high-frequency voltage from the high-frequency voltage generation unit 61 to the first electrode 51 and the second electrode 52 is stopped based on a result of detection of a change in the alternating current electric field generated from the alternating current electric field generation unit 41. Thus, even in a case in which the first electrode 51 and the second electrode 52 are deformed due to aging or usage conditions unintended by the designer, for example, and an abnormality such as an excessive change in the alternating current electric field generated from the alternating current electric field generation unit 41 occurs, generation of the high-frequency voltage can be stopped based on a detected change in the alternating current electric field, and safety with respect to the occurrence of an abnormality can be increased.

(16) The generation of the high-frequency voltage from the high-frequency voltage generation unit 61 to the first electrode 51 and the second electrode 52 is stopped based on a result of detection of a temperature of at least one of the conductor 53, the first electrode 51, and the second electrode 52. Thus, even when an abnormality occurs such as when the temperature of at least one of the conductor 53, the first electrode 51, and the second electrode 52 rises excessively due to aging or usage conditions not intended by the designer, for example, it is possible to stop the generation of the high-frequency voltage based on the detected temperature and increase safety with respect to the occurrence of an abnormality.

(17) The electric field detection sensor 36 includes electric field detection antennas that detect the strength of the alternating current electric field, and the electric field detection antennas are disposed spaced apart from the first electrode 51 and the second electrode 52. Therefore, a change in the alternating current electric field can be detected at a position spaced apart from the first electrode 51 and the second electrode 52, such as, for example, a region in which the liquid ejected onto the medium 99 is to be dried or, rather than a position in the vicinity spaced apart from the first electrode 51 and the second electrode 52, outside the region in which the liquid ejected onto the medium 99 is to be dried, for example. Accordingly, it is possible to increase the possibility of detection of a change in the alternating current electric field generated from the alternating current electric field generation unit 41.

(18) When the generation of high-frequency voltage from the high-frequency voltage generation unit 61 to the first electrode 51 and the second electrode 52 is stopped, the power source of the amplifier circuit 64 is shut off, making it possible to protect the high-frequency voltage generation unit 61.

(19) A change in the impedance of the conductor 53, the first electrode 51, and the second electrode 52 is detected, making it possible to detect, in advance, a change in the alternating current electric field generated from the alternating current electric field generation unit 41 before an excessive change in the alternating current electric field generated from the alternating current electric field generation unit 41. Accordingly, it is possible to increase the possibility of detection of a change in the alternating current electric field generated from the alternating current electric field generation unit 41.

Second Exemplary Embodiment

Next, a second exemplary embodiment that embodies the present disclosure will be described.

In the first exemplary embodiment, an alternating current electric field in one type of frequency band is configured to be generated, but in the second exemplary embodiment, an alternating current electric field in a frequency band of any one of alternating current electric fields in a plurality of frequency bands is configured to be selectively generated. In the following description, the same components and the same control contents as those of the exemplary embodiment described above are denoted using the same reference signs, and duplicate descriptions thereof will be omitted or simplified.

In the second exemplary embodiment, the alternating current electric field generation unit 41 is configured to selectively generate any one of a plurality of types of high-frequency voltages having different frequencies. To give a specific example, the alternating current electric field generation unit 41 selectively generates either an alternating current electric field in a first frequency band such as 915 MH, for example, or an alternating current electric field in a second frequency band such as 2.4 GHz, for example.

In this case, the alternating current electric field generation unit 41 includes generators and a high-frequency voltage generation unit of a first system for generating the alternating current electric field in the first frequency band, and generators and a high-frequency voltage generation unit of a second system for generating the alternating current electric field in the second frequency band. The generators of the first system and the generators of the second system are alternately disposed so as to be adjacent to each other. As a result, variations in the strength of the alternating current electric field per unit area of the medium 99 can be suppressed.

In a case in which an alternating current electric field in the first frequency band is to be generated, the control unit 23 controls the high-frequency voltage generation unit of the first system and generates an alternating current electric field in the first frequency band from the generators of the first system. In a case in which an alternating current electric field in the second frequency band is to be generated, the control unit 23 controls the high-frequency voltage generation unit of the second system and generates an alternating current electric field in the second frequency band from the generators of the second system.

As described above, according to this exemplary embodiment, the following advantages can be achieved in addition to (1) to (19) of the first exemplary embodiment.

(20) The alternating current electric field generation unit 41 selectively generates any one of a plurality of types of alternating current electric fields having different frequencies, making it possible to change the heating depth in the thickness direction of the liquid ejected onto the medium 99 in accordance with the frequency. Accordingly, by changing the frequency according to, for example, the thickness and the material of the medium 99, the ease of penetration of the liquid, and the ejection amount and the material of the liquid ejected onto the medium 99, or the like, it is possible to dry the medium 99 by heating the liquid in accordance with the state of the medium 99 and thus improve the printing quality.

Third Exemplary Embodiment

Next, a third exemplary embodiment that embodies the present disclosure will be described.

While the cover 42 covering the generators 43 is fixed to the carriage 31 in the first exemplary embodiment, the cover 42 is movable between a first position covering the generators 43 and a second position not covering the generators 43 in the third exemplary embodiment.

Figure 9:
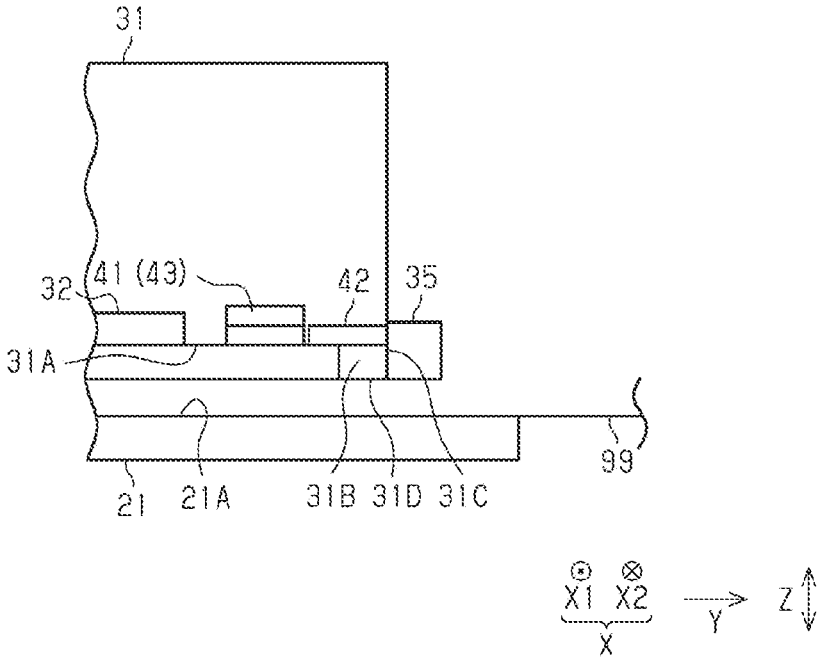
FIG. 9 is a schematic side sectional side view illustrating a liquid ejecting device according to a third exemplary embodiment.

As illustrated in FIG. 9, in the third exemplary embodiment, the cover 42 is movably mounted on the carriage 31. The cover 42 is disposed in the second position not covering the generators 43. In this way, the cover 42 is configured to be movable between the first position and the second position. Thus, the cover 42 is moved to the second position, making it possible to dry the medium 99 by the alternating current electric field generated from the generators 43. In this case, the cover 42 may be formed of a material that does not readily transmit an alternating current electric field.

The cover 42 is not limited to being downstream of the liquid ejecting head 32 in the transport direction Y of the medium 99, and may be disposed on both sides of the medium 99 in the width direction X. For example, when the carriage 31 moves in the width direction X, the covers 42 may be configured to lock with locking portions of the support portion 21 or the like, and thus move in the width direction X, opening and closing. Further, for example, a motor for moving the covers 42 may be provided, and the control unit 23 may drive the motor, thereby moving the covers 42 and opening and closing the covers 42. In particular, when the liquid is ejected from the liquid ejecting head 32 both when the carriage 31 moves in the first width direction X1 and when the carriage 31 moves in the second width direction X2, the cover 42 disposed in the direction in which the carriage 31 moves may be configured to open, and the cover 42 disposed in the direction reverse to the direction in which the carriage 31 moves may be configured to close. In this case, for example, the support portion 21 includes the locking portion at both ends in the width direction X. The configuration may be such that, in conjunction with the movement of the carriage 31 in the width direction X, the covers 42 lock with the locking portions of the support portion 21, the cover 42 disposed in the direction in which the carriage 31 moves opens, and the cover 42 disposed in the direction reverse to the direction in which the carriage 31 moves closes. Further, the control unit 23 may also execute control so as to selectively open and close the covers 42 in accordance with a print mode in which an image is to be printed, such as the resolution included in the print job.

Fourth Exemplary Embodiment

Next, a fourth exemplary embodiment that embodies the present disclosure will be described.

In the fourth exemplary embodiment, the configuration is such that the characteristics of the coil 55 being deformed by thermal expansion are utilized and thus, when abnormal heat generation of the generator 43 occurs, the coil 55 expands and disconnection occurs.

Figure 10:
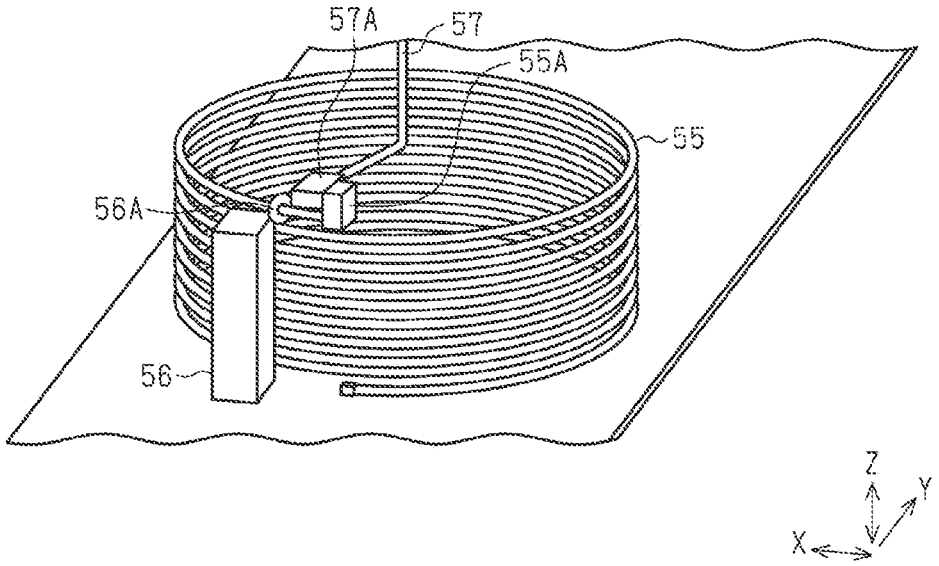
FIG. 10 is a perspective view illustrating a generator according to a fourth exemplary embodiment.

As illustrated in FIG. 10, in the fourth exemplary embodiment, the generator 43 includes a coil support portion 56 that supports the coil 55. The coil support portion 56 is disposed on an upper surface of the first electrode 51. The coil support portion 56 includes an opening 56A in a direction reverse to the first electrode 51.

The coil 55 is disposed so as to pass through the opening 56A. Thus, the coil 55 is supported by the coil support portion 56. The coil 55 includes a contact portion 55A that comes into contact with a contact portion 57A of a contact member 57.

The conductor 53 includes the contact member 57. The contact member 57 includes the contact portion 57A that comes into contact with the contact portion 55A of the coil 55. The contact member 57 is coupled to the inner conductor 54A of the coaxial cable 54.

When abnormal heating has not occurred in the coil 55, the contact portion 55A of the coil 55 and the contact portion 57A of the contact member 57 are in contact, and the coil 55 and the contact member 57 are electrically coupled. When abnormal heating occurs in the coil 55, the coil 55 lengthens in a state of being supported by the coil support portion 56 due to thermal expansion of the coil 55. Thus, the contact portion 55A of the coil 55 and the contact portion 57A of the contact member 57 are not in contact, and the coil 55 and the contact member 57 are not electrically coupled. In this way, the high-frequency voltage is not introduced and the generator 43 can be made to not generate an alternating current electric field.

Further, a protection circuit is coupled between the amplifier circuit 64 of the high-frequency voltage generation unit 61 and the generator 43. The protection circuit includes a clamping circuit. By arranging such a protective circuit, it is possible to protect the amplifier circuit 64 even when the coil 55 and the contact member 57 change from a state of being electrically coupled to a state of not being electrically coupled, causing the amplifier circuit 64 to be in a no-load state.

Fifth Exemplary Embodiment

Next, a fifth exemplary embodiment that embodies the present disclosure will be described.

In the fifth exemplary embodiment, the configuration is such that the plurality of generators 43 constituting the alternating current electric field generation unit 41 are coupled by a member having flexibility, such as a thread, a wire, or a resin rod, for example, and the tension of the coupled members is detected.

Figure 11:
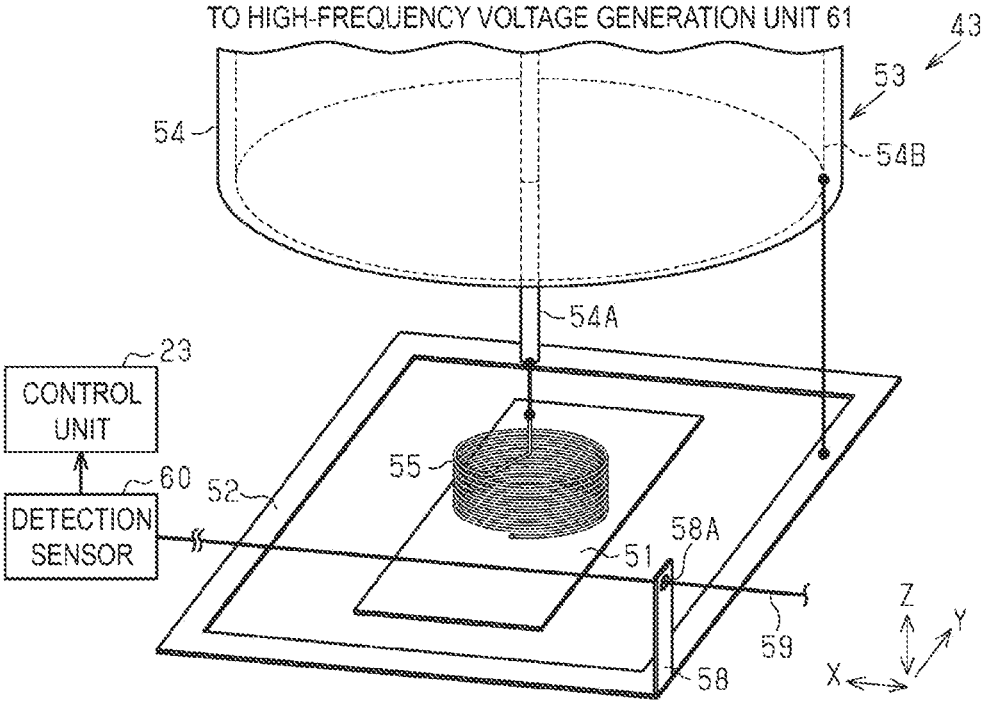
FIG. 11 is a perspective view illustrating a generator according to a fifth exemplary embodiment.

As illustrated in FIG. 11, in the fifth exemplary embodiment, the generator 43 includes a coupling portion 58 extending from the second electrode 52 in the vertical direction Z. The coupling portion 58 includes an opening 58A at the tip end thereof. The opening 58A opens in the width direction X, for example.

A coupling member 59 is fixed to the opening 58A. The coupling member 59 is a member for coupling the plurality of generators 43 disposed in the width direction X. The coupling member 59 is fixed to each of the plurality of generators 43 disposed in the width direction X.

The liquid ejecting device 14 includes a detection sensor 60 that detects the tension of the coupling member 59. When the tension of the coupling member is greater than or equal to a specified tension based on a signal from the detection sensor 60, the control unit 23 determines that at least one of the plurality of generators 43 has been displaced and determines that a regulation condition has been satisfied. For example, when cloth is adopted as the medium 99, the generator 43 may be physically displaced due to an external force applied to the generator 43, such as when a thread protrudes from the cloth during textile printing and the thread comes into contact with the generator 43. Even in such a case, physical displacement of the generator 43 is detected, and the regulation condition is satisfied.

The coupling member 59 may be fixed to each of the plurality of generators 43 disposed in the transport direction Y, for example, or may be fixed to each of the plurality of generators 43 disposed in the width direction X and fixed to each of the plurality of generators 43 disposed in the transport direction Y, for example. Further, for example, the first electrode 51 may include the coupling portion 58. In this manner, the coupling member 59 and the detection sensor 60 are switches fixed to the first electrode 51 or the second electrode 52 and operated in accordance with the displacement of the first electrode 51 or the second electrode 52. Such a coupling member 59 and a detection sensor 60 correspond to an example of a detection unit.

With such a configuration, when, for example, the first electrode 51 or the second electrode 52 deforms due to contact with the medium 99, causing the alternating current electric field generated from the alternating current electric field generation unit 41 to excessively change, displacement of the first electrode 51 or the second electrode 52 can be physically detected. Accordingly, it is possible to increase the possibility of detection of a change in the alternating current electric field generated from the alternating current electric field generation unit 41.

Note that the exemplary embodiments described above may be modified to forms such as those of the following modified examples. Furthermore, the exemplary embodiments described above may be combined as appropriate with a modified example below to form a further modified example, and the modified examples below may be combined as appropriate to form a further modified example.

The control unit 23 executes the monitoring process after the power source of the liquid ejecting device 14 is turned on, at predetermined interval when printing is performed, but no such limitation is intended. For example, the control unit 23 may execute the monitoring process immediately after the power source of the liquid ejecting device 14 is turned on and subsequently execute or not execute the monitoring process. Further, a combination of these may be used.

The monitoring circuit 62 may, for example, block the power source voltage supplied to the amplifier circuit 64 of the high-frequency voltage generation unit 61 by outputting a signal to the amplifier circuit 64 without outputting a signal to the control unit 23.

The power source voltage supplied to the amplifier circuit 64 is blocked when an abnormality is detected, but no such limitation is intended and, for example, the power source voltage supplied to the high-frequency voltage generation unit 61 itself may be blocked. Further, for example, the printing itself of the liquid ejecting device 14 may be canceled or not canceled.

The support portion 21 may include a suction hole, and the liquid ejecting device 14 may include a suction fan. The suction hole of the support portion 21 is a hole that passes through a support surface that supports the medium 99 and a back surface of the support surface. The suction fan suctions air through the suction hole from the support surface to the back surface. The control unit 23 performs control to drive the suction fan. In this case, for example, when abnormal heat generation in the generator 43 is detected, the control unit 23 may control the suction fan, increasing a suction force that suctions air through the suction hole from the support surface to the back surface. This makes it possible to promote heat dissipation of the generator 43 disposed on the surface 21A of the support portion 21 and increase the drying efficiency of the medium 99.

The characteristic that, when liquid is not present in the medium 99, a resonance frequency of the generator 43 changes and the reflected waves from the generator 43 to the high-frequency voltage generation unit 61 increase may be utilized, and the monitoring circuit 62 may include a circulator that detects the reflected waves and thus detects whether liquid is present or not present in the medium 99.

A temperature sensor such as a thermistor or a thermostat may be disposed in the generator 43, and a temperature abnormality of the generator 43 may be detected based on a signal from the temperature sensor. That is, such a temperature sensor corresponds to an example of a temperature detection unit that detects a temperature of at least one of the conductor 53, the first electrode 51, and the second electrode 52.

An infrared sensor may be disposed at a position near the generator 43, although spaced apart from the generator 43, and a temperature abnormality of the generator 43 may be detected based on a signal from the infrared sensor. Such an infrared sensor corresponds to an example of a temperature detection unit that detects a temperature of at least one of the conductor 53, the first electrode 51, and the second electrode 52.

The control unit 23 may perform control so as to generate an alternating current electric field from the alternating current electric field generation unit 41 when it is determined that there is a medium 99 onto which the liquid was ejected in a region facing the alternating current electric field generation unit 41, and to not generate an alternating current electric field from the alternating current electric field generation unit 41 when it is determined that there is not a medium 99 onto which the liquid was ejected in the region facing the alternating current electric field generation unit 41. For example, the control unit 23 may, from printed image data, refer to whether or not the liquid was ejected onto the region facing the alternating current electric field generation unit 41, and determine that there is a medium 99 onto which the liquid was ejected in the region facing the alternating current electric field generation unit 41. Further, for example, the control unit 23 may monitor a drive signal output to the printing unit 22 based on printed image data and, from that drive signal, refer to whether or not the liquid was ejected onto the region facing the alternating current electric field generation unit 41, and determine that there is a medium 99 onto which the liquid was ejected in the region facing the alternating current electric field generation unit 41.

Entry of a finger of the user or the like between the support portion 21 and the optical sensor 35 is configured to be detectable based on the result detected by the optical sensor 35, but no such limitation is intended. For example, deformation of the medium 99 between the support portion 21 and the optical sensor 35 due to jamming of the medium 99 or the like may be configured to be detectable. An intensity of the light detected by the optical sensor 35 differs depending on whether, between the support portion 21 and the optical sensor 35, there is a finger of the user or the like, the medium 99 is deformed, or neither of these has occurred. Therefore, based on the result detected by the optical sensor 35, it is possible to detect entry of a finger of the user or the like and deformation of the medium 99 between the optical sensor 35 and the support portion 21.

The optical sensor 35 is mounted on the outer peripheral surface of the carriage 31, but no such limitation is intended. For example, on the carriage 31, the optical sensor 35 may be mounted on the opposing surface 31A of the carriage 31 and, for example, the optical sensor 35 may not be mounted. To give a specific example, when thin paper, vinyl, or the like is adopted as the medium 99, the thickness of the medium 99 does not increase and thus the configuration may include the protruding portion 31B and, in this case, the optical sensor 35 may be, unproblematically, not mounted.

The carriage 31 includes the protruding portion 31B protruding downward from the opposing surface 31A, but no such limitation is intended. For example, the carriage 31 may have a configuration in which the protruding portion 31B is not included. To give a specific example, when a carpet, board, or the like is adopted as the medium 99, the thickness of the medium 99 is large and thus a configuration in which the protruding portion 31B is not included is more preferable, and preferably the optical sensor 35 is mounted.

In the case of a configuration in which the optical sensor 35 is not mounted and in the case of a configuration in which the protruding portion 31B is not included, the distance between the support portion 21 and the first electrode 51 as well as the second electrode 52 is preferably from 1 mm to 20 mm, which does not allow a finger of the user or the like to enter therebetween.

The liquid ejecting head 32 is disposed on the same surface as the opposing surface 31A of the carriage 31, but is not limited thereto and, for example, may be disposed below the opposing surface 31A of the carriage 31 or may be disposed above the opposing surface 31A of the carriage 31, protruding from the opposing surface 31A of the carriage 31.

The cover 42 is disposed on the same surface as the opposing surface 31A of the carriage 31, but is not limited thereto and, for example, may be disposed below the opposing surface 31A of the carriage 31 or may be disposed above the opposing surface 31A of the carriage 31, protruding from the opposing surface 31A of the carriage 31.

At least one of the first air blowing fan 34C and the second air blowing fan 34D may blow air in the reverse direction. The first air blowing fan 34C and the second air blowing fan 34D blow air in the vertical direction Z, but are not limited thereto and may, for example, blow air from downstream to upstream in the transport direction Y of the medium 99. Either one of the first air blowing fan 34C and the second air blowing fan 34D need not be arranged.

The first electrode 51 may be a flat plate having a square shape in plan view. The second electrode 52 need not surround the first electrode 51 in plan view. The second electrode 52 may be a flat plate having a square shape. That is, the first electrode 51 and the second electrode 52 need only be disposed adjacent to each other.

The generator 43 of the alternating current electric field generation unit 41 is configured with both the first electrode 51 and the second electrode 52 adjustable in the vertical direction Z, but no such limitation is intended. For example, the angles of the first electrode 51 and the second electrode 52 may be configured to be adjustable. When the angles of the first electrode 51 and the second electrode 52 are to be adjusted, the configuration may be such that one of the first electrode 51 and the second electrode 52 is moved upward or downward without moving the other, or the configuration may be such that one of the first electrode 51 and the second electrode 52 is moved upward and the other is moved downward. In particular, adjustment can be made by changing the angles of the first electrode 51 and the second electrode 52 to the direction in which the liquid ejecting head 32 is disposed, thereby bringing the position of the medium 99 facing the first electrode 51 and the second electrode 52 closer in the direction in which the liquid ejecting head 32 is disposed, and making the distance to the medium 99 facing the first electrode 51 and the second electrode 52 shorter. On the other hand, adjustment can be made by changing the angles of the first electrode 51 and the second electrode 52 to the direction reverse to the direction in which the liquid ejecting head 32 is disposed, thereby distancing the medium 99 facing the first electrode 51 and the second electrode 52 away from the direction in which the liquid ejecting head 32 is disposed, and making the distance to the medium 99 facing the first electrode 51 and the second electrode 52 longer. In this way, by adopting a configuration in which the angles of the first electrode 51 and the second electrode 52 are adjustable, it is possible to adjust the position of the medium 99 facing the first electrode 51 and the second electrode 52 and the distance to the medium 99 facing the first electrode 51 and the second electrode 52.

The alternating current electric field generation unit 41 is adjustable in the vertical direction Z separately from the liquid ejecting head 32, but is not limited thereto and may, for example, be adjustable in the vertical direction Z in conjunction with the liquid ejecting head 32.

When the alternating current electric field generation unit 41 is to selectively generate alternating current electric fields in a plurality of frequency bands, any one of the alternating current electric fields in the plurality of frequency bands may be generated by changing at least one of the generator 43 of the coil 55 and the like, the high-frequency voltage generation circuit 63 of the high-frequency voltage generation unit 61, and the amplifier circuit 64.

The alternating current electric field generation unit 41 includes the generators 43 and the high-frequency voltage generation unit 61 of a plurality of systems, but is not limited thereto and may, for example, include the generators 43 of a plurality of systems, and the high-frequency voltage generation unit 61 of a single system that outputs the high-frequency voltage to the generators 43 of the plurality of systems. Further, for example, the alternating current electric field generation unit 41 may include the generators 43 of a plurality of systems, the amplifier circuits 64 of a plurality of systems, and the high-frequency voltage generation circuit 63 of a single system that outputs a voltage to the amplifier circuits 64 of the plurality of systems.

The high-frequency voltage generation unit 61 is mounted on the carriage 31, but is not limited thereto and may, for example, not be mounted on the carriage 31. When the high-frequency voltage generation unit 61 is configured to not be mounted on the carriage 31, the weight of the carriage 31 can be reduced. On the other hand, when the high-frequency voltage generation unit 61 is configured to be mounted on the carriage 31, a transmission distance of the high-frequency voltage can be shortened, attenuation of the high-frequency voltage can be suppressed, and power consumption can be reduced.

The alternating current electric field generation unit 41 may be disposed separately from the carriage 31 rather than mounted on the carriage 31. In this case, the weight of the carriage 31 can be reduced. Further, for example, when disposed separately from the carriage 31 rather than mounted on the carriage 31, the alternating current electric field generation unit 41 need not move even during reciprocation in the width direction X. By adopting a configuration in which reciprocation in the X direction is performed without the alternating current electric field generation unit 41 being mounted on the carriage 31, it is possible to reduce the number of generators 43 configured as the alternating current electric field generation unit 41.

Figure 12:
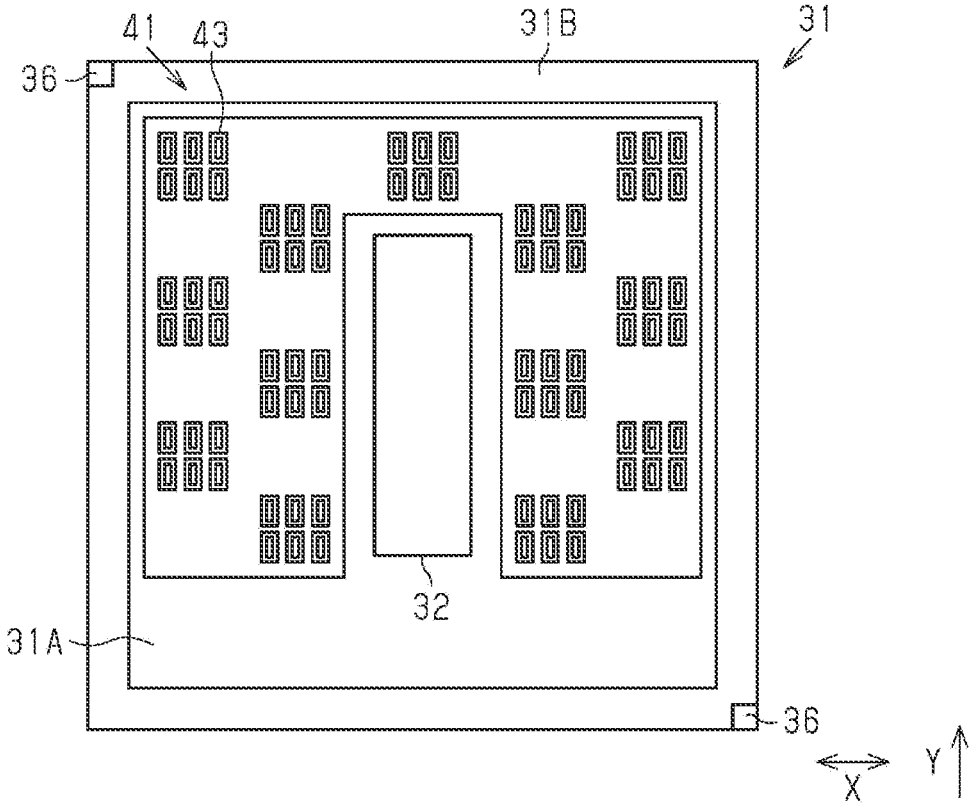
FIG. 12 is a schematic bottom view illustrating a carriage.

As illustrated in FIG. 12, for example, the generators 43 of the first alternating current electric field generation unit 41 need only be disposed at appropriate positions with respect to the liquid ejecting head 32. As a specific example, the generators 43 may be disposed at appropriate positions with respect to the liquid ejecting head 32, and thus dry the liquid ejected onto the medium 99 in stages.

The generators 43 of the alternating current electric field generation unit 41 may be disposed in a single column rather than in a plurality of columns with respect to the liquid ejecting head 32. For example, the generators 43 of the alternating current electric field generation unit 41 may be disposed on one side and not on the other side of the liquid ejecting head 32 in the width direction X. For example, the generators 43 of the alternating current electric field generation unit 41 need not be disposed on both sides of the liquid ejecting head 32 in the width direction X. For example, the generators 43 of the alternating current electric field generation unit 41 need not be disposed downstream of the liquid ejecting head 32 in the transport direction of the medium 99.

The generators 43 of the alternating current electric field generation unit 41 may be disposed upstream of the liquid ejecting head 32 in the transport direction of the medium 99. In the related art, depending on the state of the medium 99 before the liquid is ejected, such as the water content of the medium 99 to be transported, there is a risk that the printing quality will deteriorate, such as the occurrence of bleed-through of the liquid, for example. Therefore, herein, the first electrode 51 and the second electrode 52 are disposed upstream of the liquid ejecting head 32 in the transport direction of the medium 99 and thus, after the medium 99 is heated and dried, the medium 99 is transported and the liquid can be ejected from the liquid ejecting head 32 onto the transported medium. Accordingly, it is possible to dry the medium before the liquid is ejected from the liquid ejecting head 32 onto the medium, and improve the printing quality.

A pretreatment unit that performs pretreatment on the medium to be printed may be disposed upstream of the printing unit 22 in the transport direction of the medium 99. As a specific example, a pretreatment unit that applies a treatment liquid to the medium 99 may be disposed. This pretreatment unit may be mounted as the liquid ejecting device 14 or as the printing system 11 outside the liquid ejecting device 14.

In the related art, depending on the state of the medium 99 before the liquid is ejected, such as the water content of the medium 99 to be transported, there is a risk that the printing quality will deteriorate, such as the occurrence of bleed-through of the liquid, for example. Therefore, herein, it is possible to heat the treatment liquid applied to the medium 99 and dry the medium 99 before the liquid is ejected from the liquid ejecting head 32 onto the medium 99, and improve the printing quality.

The medium 99 is not limited to a sheet, and may be a film or a sheet made of a synthetic resin, a cloth, a nonwoven cloth, a laminate sheet, or the like. Further, the medium 99 is not limited to a medium having an elongated shape such as roll paper and may be single sheet paper, and is not limited to such a medium in which a wrinkle occurs when a printing defect occurs and may be a medium in which curling occurs when a printing defect occurs.

The path for transporting the medium 99 is not limited to a horizontally extending path, and may be a path of any shape such as, for example, a trapezoidal path in side view, and a path that folds back from one transport direction to carry out transport in the other transport direction.

The liquid ejecting device 14 may include at least one of the holding device 12 and the winding device 13.

The liquid ejecting device 14 may be configured to further dry the medium 99 on which printing was performed in addition to the drying unit 33.

The carriage 31 may be linearly disposed across the width direction X of the medium 99. That is, the liquid ejecting device 14 may be a line printer in which the liquid ejecting head 32 disposed across the width of the medium 99 ejects the liquid for a line all at once.

Hereinafter, technical concepts and effects thereof that are understood from the above-described exemplary embodiments and modified examples will be described.

A liquid ejecting device includes a liquid ejecting head configured to eject a liquid onto a medium, an alternating current electric field generation unit configured to generate an alternating current electric field, a control unit configured to control the alternating current electric field generation unit, and a detection unit configured to detect a change in the alternating current electric field generated from the alternating current electric field generation unit. The alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit, and the control unit is configured to stop generation of the high-frequency voltage from the high-frequency voltage generation unit to the first electrode and the second electrode based on a result detected by the detection unit.

According to this configuration, the detection unit configured to detect a change in an alternating current electric field generated from the alternating current electric field generation unit is provided and, based on the result detected by the detection unit, the generation of the high-frequency voltage from the high-frequency voltage generation unit to the first electrode and the second electrode is stopped. Thus, even in a case in which the first electrode and the second electrode are deformed due to aging or usage conditions unintended by the designer, for example, and an abnormality such as an excessive change in the alternating current electric field generated from the alternating current electric field generation unit occurs, generation of the high-frequency voltage can be stopped based on a detected change in the alternating current electric field, and safety with respect to the occurrence of an abnormality can be increased.

In the liquid ejecting device described above, the high-frequency voltage generation unit may include a high-frequency voltage generation circuit configured to generate a high-frequency voltage and an amplifier circuit configured to amplify the high-frequency voltage, and the control unit may be configured to shut off a power source of the amplifier circuit, thereby stopping generation of the high-frequency voltage from the high-frequency voltage generation unit to the first electrode and the second electrode.

According to this configuration, when the generation of high-frequency voltage from the high-frequency voltage generation unit to the first electrode and the second electrode is stopped, the power source of the amplifier circuit is shut off, making it possible to protect the high-frequency voltage generation unit.

In the liquid ejecting device described above, the detection unit may be disposed spaced apart from the first electrode and the second electrode and include an antenna configured to detect an alternating current electric field.

According to this configuration, the detection unit is disposed spaced apart from the first electrode and the second electrode and includes an antenna configured to detect an alternating current electric field. Therefore, a change in the alternating current electric field can be detected at a position spaced apart from the first electrode and the second electrode, such as, for example, a region in which the liquid ejected onto the medium is to be dried or, rather than a position in the vicinity spaced apart from the first electrode and the second electrode, outside the region in which the liquid ejected onto the medium is to be dried, for example. Accordingly, it is possible to increase the possibility of detection of a change in the alternating current electric field generated from the alternating current electric field generation unit.

In the liquid ejecting device described above, the detection unit may include a switch fixed to the first electrode or the second electrode and configured to operate in response to displacement of the first electrode or the second electrode.

According to this configuration, the detection unit includes the switch fixed to the first electrode or the second electrode and configured to operate in response to displacement of the first electrode or the second electrode. Therefore, when, for example, the first electrode or the second electrode deforms due to contact with the medium, causing the alternating current electric field generated from the alternating current electric field generation unit to excessively change, displacement of the first electrode 51 or the second electrode can be physically detected. Accordingly, it is possible to increase the possibility of detection of a change in the alternating current electric field generated from the alternating current electric field generation unit.

In the liquid ejecting device described above, the detection unit may be configured to detect a change in impedance of the conductor, the first electrode, and the second electrode.

According to this configuration, a change in the impedance of the conductor, the first electrode, and the second electrode is detected, making it possible to detect, in advance, a change in the alternating current electric field generated from the alternating current electric field generation unit before an excessive change in the alternating current electric field generated from the alternating current electric field generation unit. Accordingly, it is possible to increase the possibility of detection of a change in the alternating current electric field generated from the alternating current electric field generation unit.

A liquid ejecting device includes a liquid ejecting head configured to eject a liquid onto a medium, an alternating current electric field generation unit configured to generate an alternating current electric field, a control unit configured to control the alternating current electric field generation unit, and a temperature detection unit configured to detect a temperature. The alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit. The temperature detection unit is configured to detect a temperature of any one of the conductor, the first electrode, and the second electrode, and the control unit is configured to stop generation of the high-frequency voltage from the high-frequency voltage generation unit to the first electrode and the second electrode based on a result detected by the temperature detection unit.

According to this configuration, the liquid ejecting device includes the temperature detection unit configured to detect a temperature of at least one of the conductor, the first electrode, and the second electrode, and the generation of the high-frequency voltage from the high-frequency voltage generation unit to the first electrode and the second electrode is stopped based on a result detected by the temperature detection unit. Thus, even when an abnormality occurs such as when the temperature of at least one of the conductor, the first electrode, and the second electrode rises excessively due to aging or usage conditions not intended by the designer, for example, it is possible to stop the generation of the high-frequency voltage based on the detected temperature and increase safety with respect to the occurrence of an abnormality.

What is claimed is:

1. A liquid ejecting device comprising:

a liquid ejecting head configured to eject a liquid onto a medium;

an alternating current electric field generation unit configured to generate an alternating current electric field;

a control unit configured to control the alternating current electric field generation unit; and a detection unit configured to detect a change in the alternating current electric field generated from the alternating current electric field generation unit, wherein the alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit, the control unit is configured to stop generation of the high-frequency voltage from the high-frequency voltage generation unit to the first electrode and the second electrode based on a result detected by the detection unit, and the second electrode surrounds the first electrode in plan view.

2. The liquid ejecting device according to claim 1, wherein the high-frequency voltage generation unit includes a high-frequency voltage generation circuit configured to generate a high-frequency voltage and an amplifier circuit configured to amplify the high-frequency voltage, and the control unit is configured to shut off a power source of the amplifier circuit, thereby stopping generation of the high-frequency voltage from the high-frequency voltage generation unit to the first electrode and the second electrode.

3. The liquid ejecting device according to claim 1, wherein the detection unit is disposed spaced apart from the first electrode and the second electrode and includes an antenna configured to detect an alternating current electric field.

4. The liquid ejecting device according to claim 1, wherein the detection unit includes a switch fixed to the first electrode or the second electrode and configured to operate in response to displacement of the first electrode or the second electrode.

5. The liquid ejecting device according to claim 1, wherein the detection unit is configured to detect a change in impedance of the conductor, the first electrode, and the second electrode.

6. A liquid ejecting device comprising:

a liquid ejecting head configured to eject a liquid onto a medium;

an alternating current electric field generation unit configured to generate an alternating current electric field;

a control unit configured to control the alternating current electric field generation unit; and a temperature detection unit configured to detect a temperature, wherein the alternating current electric field generation unit includes a first electrode and a second electrode disposed adjacent to each other, a high-frequency voltage generation unit configured to generate a high-frequency voltage to the first electrode and the second electrode, and a conductor configured to electrically couple the first electrode and the second electrode to the high-frequency voltage generation unit, the temperature detection unit is configured to detect a temperature of any one of the conductor, the first electrode, and the second electrode, the control unit is configured to stop generation of the high-frequency voltage from the high-frequency voltage generation unit to the first electrode and the second electrode based on a result detected by the temperature detection unit, and the second electrode surrounds the first electrode in plan view.

* * * * *